United States Patent [19]

Han

[11] Patent Number: 4,789,074

[45] Date of Patent: Dec. 6, 1988

[54] CAP LINER

[75] Inventor: Hak-Rhim Han, Newport, Minn.

[73] Assignee: Minnesota Mining and Manufacturing Company, St. Paul, Minn.

[21] Appl. No.: 72,136

[22] Filed: Jul. 10, 1987

[51] Int. Cl.[4] ..... B65D 53/04

[52] U.S. Cl. ..... 215/347; 215/230; 215/348; 428/116; 428/118; 428/119

[58] Field of Search ..... 215/347; 428/118, 119, 428/116

[56] References Cited

U.S. PATENT DOCUMENTS

| | | | |
|---|---|---|---|
| 2,477,852 | 8/1949 | Bacon | 428/116 |
| 3,786,954 | 1/1974 | Shull | 215/341 |
| 3,819,460 | 6/1974 | Dukess | 215/347 X |
| 3,922,412 | 11/1975 | Yoshikawa et al. | 428/116 X |
| 3,976,217 | 8/1976 | Dukess | 215/329 |
| 4,107,247 | 8/1978 | Dukess | 264/DIG. 3 |
| 4,121,728 | 10/1978 | Tagalakis et al. | 215/260 |
| 4,457,440 | 7/1984 | Dukess | 215/347 |
| 4,634,485 | 1/1987 | Welygan et al. | 264/177.1 X |
| 4,651,886 | 3/1987 | Stull | 215/329 |

FOREIGN PATENT DOCUMENTS

| | | | |
|---|---|---|---|
| 2622012 | 12/1977 | Fed. Rep. of Germany | 215/347 |

*Primary Examiner*—Donald F. Norton

*Attorney, Agent, or Firm*—Donald M. Sell; Leland D. Schultz

[57] ABSTRACT

A cap liner for sealing an opening between a bottle and a cap secured to the bottle. The cap liner includes a substantially fluid impervious film and a resilient, compressible foraminous reinforcing web bonded to one side of the film. The cap liner is mounted on the cap so that the opposite side of the film is adjacent to the bottle when the cap is secured to the bottle. The foraminous web is compressed between the bottle and the cap so as to resiliently urge the film into sealing contact with the bottle circumferentially about the opening.

18 Claims, 3 Drawing Sheets

CAP LINER

FIELD OF THE INVENTION

This invention relates generally to cap liners and more particularly to laminated cap liner constructions.

BACKGROUND OF THE INVENTION

Liners have been commonly used in the past for sealing between a bottle or other like container having an opening and a cap securable to the bottle for enclosing the opening. A fluid impervious seal at the bottle opening is highly desirable to preclude permeation or leakage of fluids into and/or out of the bottle. For the purposes of this application, "permeation" means the passage of a fluid directly through a barrier, such as a cap liner, by absorbing or adsorbing into the barrier at a high concentration side, diffusion through the material of the barrier in the direction of the side of lower concentration, and then desorbing from the barrier on the low concentration side. The term "leakage" on the other hand, means the passage of fluid through a gap between a barrier and an object such as a cap liner and a bottle.

Conventional cap liners have included one piece liners constructed of a material such as corrugated fiberboard, paperboard or the like, and may also include a coating on one or both major surfaces that is resistant to fluid permeation. However, such designs, although relatively inexpensive, are not flexible, durable, structurally strong, or completely effective in precluding permeation or leakage of fluids into or out of a bottle. Further, corrugated fiberboard or paperboard liners generate undesirable quantities of dust or other particulates that may contaminate the contents of the bottle.

Cap liners have been constructed of synthetic materials such as thermoplastics. U.S. Pat. No. 4,121,728 entitled "Venting Liners" and issued to Tagalakis, shows one such cap liner having a first ply constructed of an impermeable plastic and a second ply constructed of a foamed material that is compressibly deformable. Both plys are simultaneously extruded and laminated together to form the cap liner. The first ply of the cap liner is applied to the bottle as the cap is secured to the bottle. The second ply is compressed between the bottle and the cap and urges the first ply into sealing contact with the bottle.

Although cap liners such as in the Tagalakis patent are more effective than cardboard cap liners against fluid permeation or leakage, such cap liners inherently require relatively expensive materials and manufacturing techniques. For example, the second ply in the Tagalakis patent provides an imperforate and coextensive layer of deformable material, even though only a relatively small portion of the second ply is actually compressed between the bottle and the cap. The remainder of the second ply is not required to mechanically reinforce the first ply. Therefore, the non-essential material in the second ply represents an unnecessary expense.

SUMMARY OF THE INVENTION

This invention provides a cap liner for use with a bottle having an opening and a cooperative cap securable to the bottle to enclose the opening. The cap liner of this invention includes a substantially fluid impervious film having opposing first and second major surfaces. A resilient compressible foraminous reinforcing web is bonded to the first major surface of the film and is preferably coextensive with the film. The cap liner thus constructed is mounted on a cap so that when the cap is secured to the bottle, the second major surface of the film is adjacent the bottle. With the cap secured to the bottle, the foraminous web is compressed between the bottle and the cap so as to resiliently urge the film into sealing contact with the bottle circumferentially about the opening.

DETAILED DESCRIPTION OF THE INVENTION

Figure 1:
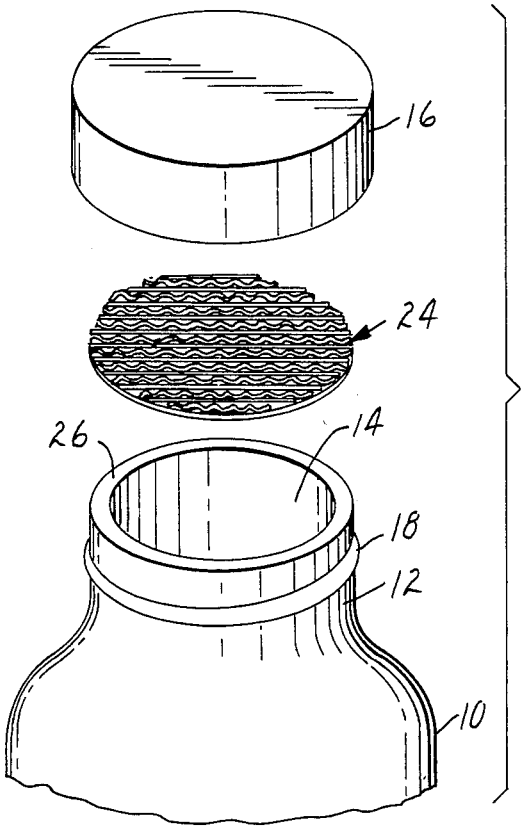
FIG. 1 is an exploded view of a bottle, a cooperative cap and a cap liner constructed according this invention.

Referring now to FIG. 1, there is shown a bottle 10 or other like container. Bottle 10 includes neck 12 and opening 14 communicating through neck 12 to the interior of the bottle. Cap 16 is provided to enclose opening 14 and is securable to the bottle by threads 18 on neck 12 of the bottle engaging cooperative threads (not shown) on the cap, as is known in the art. Alternatively, the cap may be secured to the bottle by other conventional arrangements, such as a snap closure.

Figure 4A:
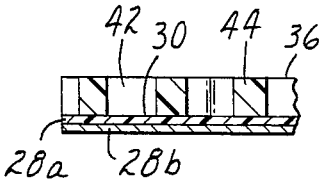
FIG. 4A is a cross sectional view of a portion of an alternative embodiment of the cap liner having a laminated film.
Figure 2:
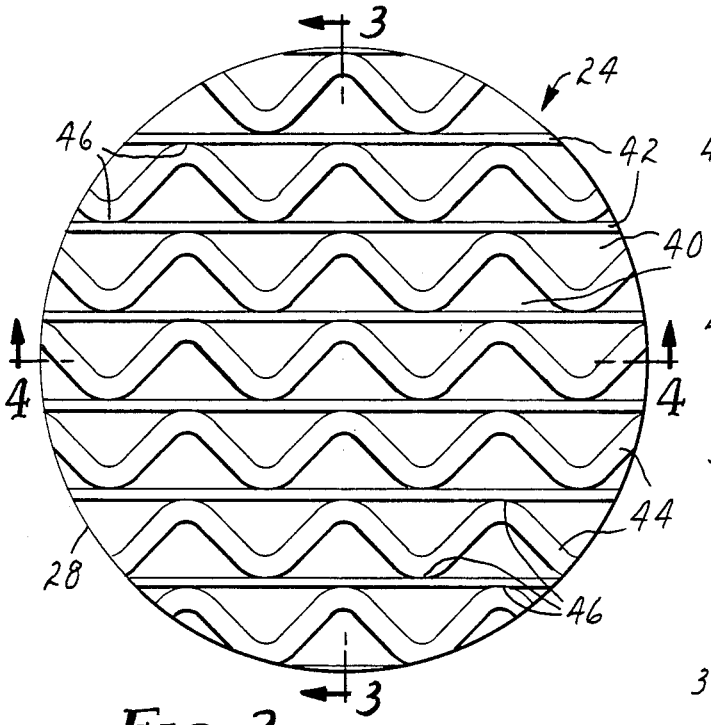
FIG. 2 is a detailed view of the cap liner of FIG. 1.
Figure 3:
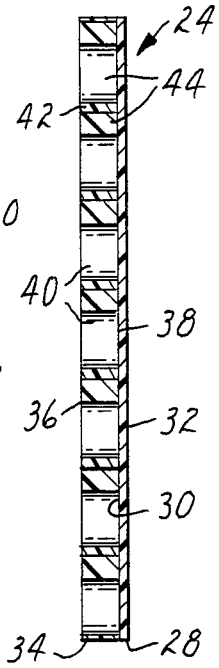
FIG. 3 is a cross sectional view along plane 3—3 of FIG. 2.
Figure 4:
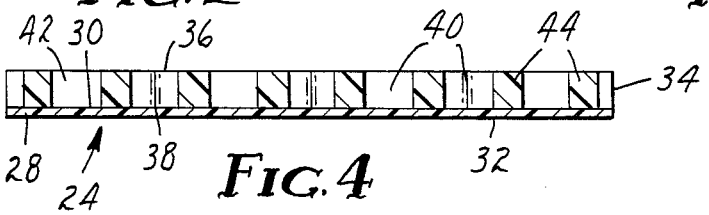
FIG. 4 is a cross sectional view along plane 4—4 of FIG. 2.

Cap liner 24 is provided for mounting on the cap 16 and sealing between the cap and the bottle circumferentially about opening 14 and specifically against lip 26. The construction of cap liner 24 is shown in greater detail in FIGS. 2–4 and includes a film 28-having opposing first and second major surfaces 30 and 32. The cap liner 24 also includes a foraminous reinforcing web 34 having opposing first and second major surfaces 36 and 38. The second major surface 38 of the reinforcing web is laminated or bonded to a first major surface 30 of the film. The first major surface of the film may be treated prior to lamination such by a corona treatment or by various chemical processes known in the art to enhance the bonding of the web to the film.

Film 28 is preferably constructed of a flexible thermoplastic material or a laminate that is chemically inert in regard to the intended contents of the bottle 10 and maintains sufficient elasticity and substantial fluid impermeability for effective sealing within a desired temperature range to which the bottle and its contents are to be exposed during use or storage. Preferably a material is selected having a density of between 0.90 and 1.69. The following thermoplastic materials are available with desired properties for constructing the film: low and medium density polyethylene, linear low density polyethylene, polyamides such as nylon, polypropylene, ethylene-vinyl alcohol copolymer laminate, ethylene vinyl acetate copolymer laminate, polyethylene terephthalate, polyvinyl chloride, polyvinylidene chloride, metalized polyethylene terephthalate, and heat sealable polypropylene. In addition, the film may comprise a thermoplastic as listed above laminated to a layer of metallic film such as aluminum foil to further reduce fluid permeation. For instance, in FIG. 4A, an alternative embodiment of a cap liner is according to this invention is illustrated that includes a laminated film having a layer 28A constructed of a thermoplastic material, and a layer 28B constructed of a metallic foil such as Aluminum foil.

Although the film 28 may be constructed of a single layer of material, it is within the scope of this invention to provide a film that is constructed of a composite or blends of certain of the above materials. Table A below lists certain blends that may be used if extremely high resistance to permeation is desired:

Table A

Aluminum Foil/Low Density Polyethylene
High Density Polyethylene/Polyamide/Ethylene Vinyl Acetate Copolymer
Polyethylene/Aluminum foil/Polyethylene
High Density Polyethylene/Ethylene Vinyl Alcohol-/Ethylene Vinyl Acetate Copolymer
Polypropylene/Polyvinylidene Chloride/Polyethylene
Polyvinylidene Chloride/Polypropylene/Polyvinylidene Chloride
Linear Low Density Polyethylene/Ethylene-vinyl Alcohol/Linear Low Density Polyethylene
Polypropylene/High Density Polyethylene/Ethylene Vinyl Alcohol/Ethylene Vinyl Acetate Copolymer
Polyethylene Terephthalate/Polyvinylidene Chloride/-Polyethylene
Polyethylene/Polyamide/Polyethylene
Low Density Polyethylene/Polyamide/Ethylene Vinyl Acetate Copolymer
Metalized Polyethylene Terephthalate/Ethylene Vinyl Acetate Copolymer
Low Density Polyethylene/Metalized Polyethylene Terephthalate/Ethylene Vinyl Acetate Copolymer Table B below lists other laminates appropriate for applications requiring only moderate permeability:

Table B

Polypropylene/Polyethylene
Polypropylene/Ethylene Vinyl Acetate Copolymer
Polyethylene/Polypropylene/Polyethylene
Polyethylene/white Polyethylene
Polyethylene Terephthalate/Ethylene Vinyl Acetate Copolymer
Polyethylene Terephthalate/Polyethylene
Polyethylene/white Polyethylene/Polyethylene
Heat sealable Polypropylene (single and 2 layer film)

The materials in the above tables and list are not to be considered exhaustive of materials that may be used in constructing the film 28.

Foraminous web 34 is constructed of a resilient, compressible, thermoplastic material. Preferably the web has a density of between 0.15 to 0.5 and a hardness of between 55 and 90 on the Shore A scale. The following non-exhaustive list of thermoplastic materials are available with desired properties for constructing the foraminous web: low density polyethylene, polypropylene, vinyl resin and vinyl acetate copolymers. Specific commercially available materials for use in constructing the foraminous web 34 include, but are not limited to: Tenite® 1390P Polyethylene; and Tenite® 1550P Polyethylene; Tenite® 811 Polyethylene; Tenite® P7673-996P Polypropylene; Tenite® P625P Polypropylene; all marketed by Eastman Chemical Products, Inc. of Kingsport, Tenn., 37662; Elvax® 250, 460, 550, or 650 Ethylene Vinyl Acetate Copolymers marketed by Du-Pont Company of Wilmington, Del., 19898.

Web 34 is constructed in foraminous sheet form and includes a plurality of spaced openings 40 extending through the sheet The openings 40 not only reduce the amount of raw material (and therefore the expense) necessary to construct the web for a given thickness and surface area, but produces a web with lower overall density than conventional cap liners without adversely affecting strength, compressibility or resiliency, particularly in a direction perpendicular to the first and second major surfaces of the web. In most applications, the formaminous web will be substantially thicker than the film to which the web is bonded. For instance, a web having a thickness of 0.10 cm (0.040 inch) may be bonded to a film having a thickness of 0.01 cm (0.004 inch) to 0.11 cm (0.0045 inch). Preferably, the foraminous web 34 is coextensive with the first major surface 30 of film 28.

In its broadest form, web 34 includes any foraminous sheet (i.e., any surface having a plurality of spaced openings of any size, shape or arrangement extending therethrough). However, in FIGS. 2–4, the foraminous web illustrated is easily and inexpensively formed by extruding a thermoplastic material pursuant to a process described in U S. Pat. No. 4,634,485 entitled "Extruded Article and Method of Making the Same" issued to Welygen et al., the contents of which are incorporated herein by reference. The web 34 thus formed consists of a plurality of straight parallel spaced filaments 42 and a plurality of undulating filaments 44 interposed between each adjacent pair of straight parallel filaments. The opposing apexes 46 of the undulating filaments are bonded to the straight parallel filaments defining the plurality of openings 40 extending through the web. A lightweight, strong foraminous web is produced that is compressible and resilient in a direction perpendicular to the first and second major surfaces of the web.

In the preferred embodiment of the invention, the web 34 is constructed of a closed cell, foamed material, such as by introducing a blowing agent prior to extrusion of the polymer melt produced according to the process of the Welygen et al. patent. Blowing agents marketed under the following trademarks may be employed in constructing the foraminous web: Kempore® 125MC or Kempore® 60, Olin Chemicals of Stamford, Conn., and Celogen HT550 TM and Celogen RA TM, by Uniroyal Chemical Co. of Naugatuck, Conn. A web is produced with a reduced density for a given thickness compared to unfoamed materials, while enhancing the resiliency and compressibility of the web thus constructed. This further reduction in density additionally diminishes the quantity of raw material required to construct the foraminous web.

Figure 6A:
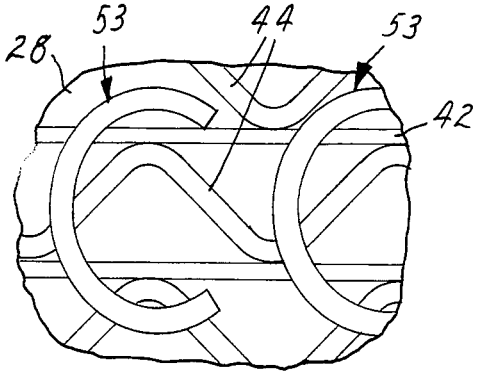
FIG. 6A is a magnified partial view along plane 6A—6A of FIG. 6 of an embodiment of the cap liner including indicia on the first major surface of the film.
Figure 5:
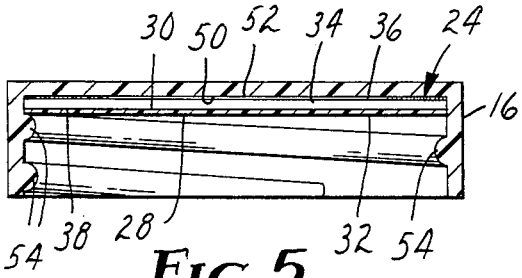
FIG. 5 is a cross sectional view of the cap liner of FIG. 1 mounted on a cap.

Referring now to FIG. 5, the cap liner 24 is cut in a size and shape for mounting against inner surface 50 of cap 16 with the foraminous web 34 presented adjacent surface 50. If necessary, the cap 16 is secured to surface 50 by adhesive layer 52, not forming a part of this invention. The film and foraminous web may be transparent, translucent, or opaque and colored, or a combination thereof. If desired, the film 28 may be transparent and indicia 53 (as shown in FIG. 6A) placed on first major surface 30, such as advertising, instructions or shelf life dates.

Figure 6:
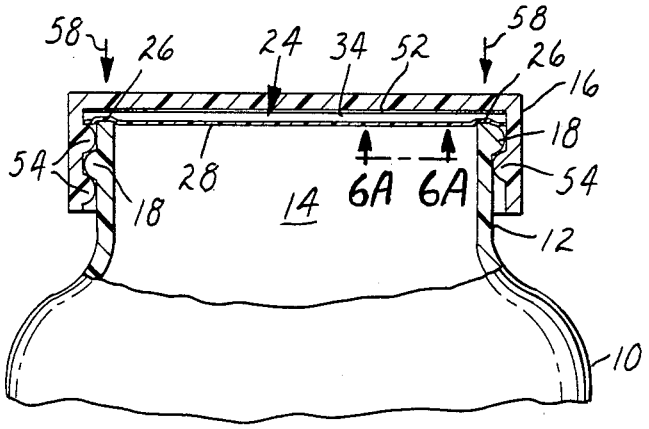
FIG. 6 is a cross sectional view of the cap liner and cap of FIG. 5 secured to a bottle.

In operation, cap 16 is secured to bottle 10 such as by threads 18 engaging cooperative threads 54 on the inside of the cap, as is also shown in FIG. 6. In a cap secured to a bottle by cooperative threads, a minimum "application torque" must be applied in tightening the cap to ensure an effective seal against leakage. Subsequently, a "release torque" within a specified range is applied to the cap to loosen and remove it from the diameter bottle. The cap 16 in FIG. 6 is tightened with a desired application torque (i.e., 2.8 joules (25 in-lbs.) for a 38 mm bottle). In doing so, second surface 32 of film 28 is placed adjacent to and in contact with circumferential lip 26 of the bottle. Further, foraminous web 24 is concentrically compressed between lip 26 and inner surface 50 of the cap in direction 58 perpendicular to first and second major surfaces 36 and 38. The compressed foraminous web acts to resiliently urge the second surface 32 of film 28 into sealing contact with the lip 26 circumferentially about opening 14 and thus simultaneously seals the bottle against both permeation through the cap liner and leakage between the cap liner and the bottle.

To detach cap 16, a release torque is applied to the cap. If the foraminous web 34 is constructed of unfoamed thermoplastic material, the release torque will generally be less than the application torque, but preferably the web is constructed so that the release torque is at least 60% of the application torque (i.e., at least 1.9 joules (15 in-lbs.) for a 38 mm bottle with an application torque of 2.8 joules (25 in-lbs.)) to ensure an effective seal against leakage by the cap liner during a minimum desired period of time. If the foraminous web is constructed of foamed thermoplastic material, the release torque may be greater than the application torque, due to the generally greater compressibility and resiliency of foamed materials. However, the cap liner should be constructed so that the release torque is not so great that the cap may not be conveniently manually removed from the bottle.. By way of example, the release torque is preferably less than 7.3 joules (65 in-lbs.) for a 38 mm (1.50") diameter bottle having an application torque of 2.8 joules (25 in-lbs.). Once the cap 16 has been removed from the bottle, the foraminous web resiliently returns to substantially its undeformed shape for subsequent reuse.

Figure 7:
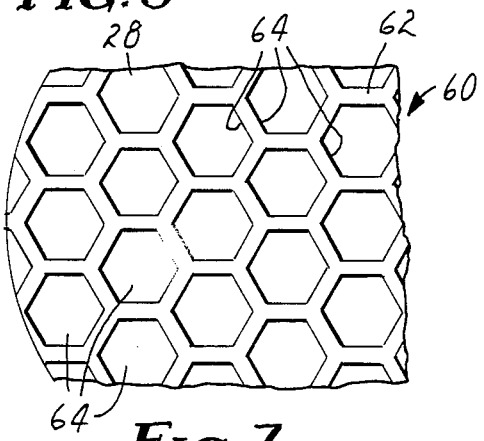
FIG. 7 is a detailed view of an alternative embodiment of the cap liner of this invention.
Figure 8:
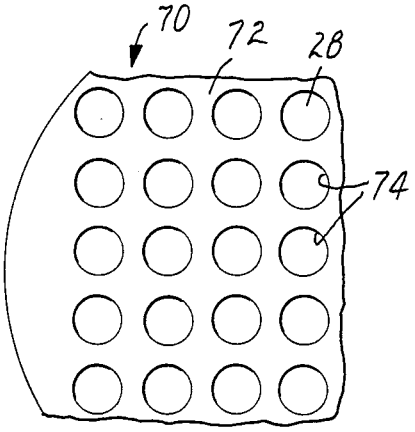
FIG. 8 is a detailed view of yet another alternative embodiment of the cap liner of this invention.
Figure 9:
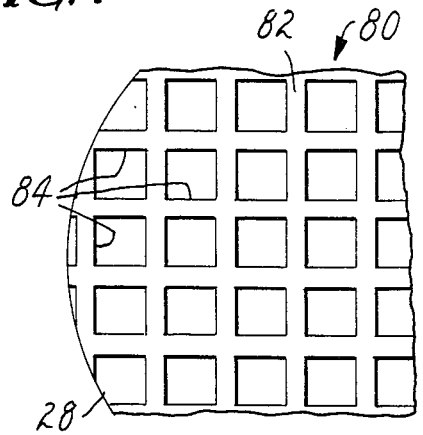
FIG. 9 is a detailed view of another alternative embodiment of the cap liner of this invention.

FIG. 7 illustrates an alternate embodiment 60 of the cap liner of this invention in which the foraminous web comprises a continuous lattice 62 defining a plurality of like sized evenly spaced hexagonal openings 64. FIG. 8 illustrates yet another alternate embodiment 70 of this invention in which the foraminous web 72 comprises a continuous lattice defining a plurality of spaced circular openings 74. FIG. 9 is another alternate embodiment 80 in which the foraminous web 82 comprises a continuous lattice having a plurality of like sized evenly spaced rectangular openings 84. Of course, other shapes, sizes and distributions of openings may be employed to form the foraminous web, if desired. These embodiments could all be constructed from an extruded thermoplastic material, similar to the previously discussed process of the Welygen et al. patent.

The following examples illustrate possible cap liner constructions according to this invention:

Example 1

Tenite® polyethylene 1550P blended with 0.9% blowing agent, Kempor 60 TM from Olin Chemical, was melted in a conventional extruder with a 24:1 length to diameter ratio, extruded and cast at 15 ft/min into the nip formed by counter rotating steel rollers as a 0.13 cm (0.050 inch) thick web. The steel rollers where half submerged in cold water and the nip had a 0.13 cm (0.050 inch) clearance between the rolls. The lamination of the foamed foraminous web to low density polyethylene film takes place at the nip where polyethylene film is threaded up to meet the foamed foraminous web.

The density of the foamed web itself was 0.18 g/cm$^3$. and the density of the final laminate cap liner was 0.25 g/cm$^3$. The foraminous web had a hardness of 55 Shore A, a compressibility of 22% and a recovery of 84% (ASTM-F806-83, Procedure F).

Example 2

Tenite® polyethylene 1390P blended with 0.6% Kempore 125MC TM blowing agent was extruded by a conventional barrel extruder through a specially designed die and laminated onto 0.011 cm (0.0045") low density polyethylene film. Total thickness of the final foamed laminate was 0.11 cm (0.045"). The density of the foamed web before lamination was significantly reduced down to 0.23 g/cm$^3$ and the density of the final laminate was 0.30 g/cm$^3$. Natural low density polyethylene sheet has a density of 0.92 g/cm$^3$ and commercial foamed low density polyethylene sheet has a 0.50 g/cm$^3$ density. The hardness of the foamed foraminous web was 65 Shore A, the compressibility was 12%, and the recovery 81% (ASTM-F806-83, Procedure F). A 38 mm (1.50") diameter screw-cap bottle was lined with a cap liner according to this example and torqued to 2.8 joules (25 in-lbs) on a 28 gm (1 oz) glass vial. A release torque of 4.5 joules (40 in-lbs) was measured (ASTM D3198-84).

Example 3

Ethylene Vinyl Acetate copolymer, Elvax 250°, was extruded with no blowing agent by a conventional barrel extruder, with a 24:1 length to diameter ratio, through a specially designed die and laminated onto 0.011 cm (0.0045") low density polyethylene film. Total thickness of the final laminate was 0.083 cm (0.033"). The hardness of this composite sheet was 85 Shore A. The thickness of the composite cap liner sheet was determined by adjusting clearance (or nip) of two counter rotating steel rollers where the lamination takes place.

Example 4

An Ethylene Vinyl Acetate copolymer, (Elvax 250®), was extruded by a conventional extruder through the same die as in Example 3 and laminated to 0.011 cm (0.0045") low density polyethylene film. Total thickness of the final composite cap liner sheet was 0.134 cm (0.053") and the hardness was 65 Shore A. The density of the cap liner sheet was 0.53 grams/cm$^3$.

Example 5

Twenty (20) 38 mm (1.50") diameter metal screw-cap bottles were lined with a ethylene-vinyl acetate copolymer web in a cap liner made according to Example 3 and torqued to 2.8 joules (25 inch-lbs.) on 28 gm (1 oz.) glass vials filled with a solution of 5% Acetic Acid and water. Half of the vials were placed upright in a 105° F. constant temperature oven and half of them kept inverted. For a 5 weeks period of evaluation, the average loss of the solution per vials was 0.005 grams per week (ASTM D2199-84), and the average release torque was 1.9 joules (17 inch-lbs) (ASTM D3198-84). No differences between upright and inverted samples were recognized. The cap liner had a compressibility of 12% and a recovery of 81% (ASTM F806-83, Procedure F).

Example 6

A plasticized Vinyl Chloride resin with 60 phr (parts per hundred resin) plasticizer (diisodecyl Phthalate) was extruded and laminated to 011 cm (0.0045") low density polyethylene film as in Example 3. The total thickness of the composite was 0.09 cm (0.034") and the hardness was 75 Shore A.

Example 7

An Ethylene Vinyl Acetate copolymer, Elvax 250 ®, blended with 0.6% Kempor 125MC blowing agent was extruded by a conventional extruder and laminated onto 0.011 cm (0.045") low density polyethylene film as in Example 3. The density of the composite cap liner sheet was 0.34 gram/cm$^3$ and the hardness was 70 Shore A. The cap liner sheet had a compressibility of 42% and a recovery of 79% (ASTM F806-83, Procedure F).

What is claimed is:

1. A cap liner for use with a bottle having an opening and a cooperative cap securable to the bottle for enclosing the opening, comprising:

(a) a substantially fluid impervious film having opposing first and second major surfaces;

(b) a compressible resilient foraminous reinforcing web bonded to said first major surface of said film; and (c) wherein the cap liner may be mounted on the cap with said second major surface of said film adjacent the bottle when the cap is secured to the bottle thereby compressing said foraminous web between the bottle and the cap for resiliently urging said film into sealing contact with the bottle circumferentially about the opening.

2. The cap liner of claim 1, wherein said foraminous web comprises:

(a) a plurality of straight parallel spaced filaments constructed of resilient compressible thermoplastic material; and (b) a plurality of undulating filaments constructed of resilient compressible thermoplastic material, each of said undulating filaments interposed between adjacent pairs of said parallel filaments with apexes of said undulating filaments bonded to said parallel filaments to form said foraminous web.

3. The cap liner of claim 1, wherein said foraminous web comprises:

a continuous lattice constructed of resilient compressible thermoplastic material having a plurality of spaced openings.

4. The cap liner of claim 1, wherein said foraminous web comprises:

a continuous lattice constructed of resilient compressible thermoplastic material and having a plurality of like sized, regularly spaced hexagonal openings.

5. The cap liner of claim 1, wherein said foraminous web comprises:

a continuous lattice constructed of resilient compressible thermoplastic material and having a plurality of like sized, regularly spaced rectangular openings.

6. The cap liner of claim 1, wherein said film is constructed of a thermoplastic material selected from the group consisting of polyethylene, polypropylene, polyamide, ethylene vinyl acetate copolymer, polyvinyl chloride, ethylene-vinyl alcohol laminate, polyester, polyvinylidene chloride and blends thereof.

7. The cap liner of claim 6, wherein said film further includes a layer of metallic film laminated to said thermoplastic material for reducing permeation of fluids through said film.

8. The cap liner of claim 1, wherein said foraminous web is constructed of a thermoplastic material selected from a group consisting of polypropylene, polyethylene, vinyl resins, vinyl acetate copolymer resins and blends thereof.

9. The cap liner of claim 1, wherein said foraminous web is constructed of a foamed thermoplastic material.

10. The cap liner of claim 1, wherein said film is substantially transparent and further including indicia on said first major surface of said film.

11. A cap liner for use with a bottle having an opening and a cooperative cap securable to the bottle for enclosing the opening, comprising:

(a) a substantially fluid impervious film constructed of thermoplastic material and having opposing first and second major surfaces;

(b) a foraminous reinforcing web bonded to said first surface of said film and coextensive therewith, said foraminous web constructed of resilient compressible thermoplastic material and including a plurality of straight, parallel spaced filaments defining a plane, and a plurality of undulating filaments having sequential opposed apexes, said undulating filaments interposed within said plane between each adjacent pair of said parallel filaments with said apexes of said undulating filaments bonded to said parallel filaments; and (c) wherein the cap liner may be mounted on the cap with said second major surface of said film adjacent the bottle when the cap is secured to the bottle, thereby compressing said foraminous web between the bottle and the cap for resiliently urging said film into sealing contact with the bottle circumferentially about the opening.

12. The cap liner of claim 11, wherein said film is constructed of a thermoplastic material selected from the group consisting of polyethylene, polypropylene, polyamide, ethylene vinyl acetate copolymer, polyvinyl chloride, ethylene-vinyl alcohol laminate, polyester, polyvinylidene chloride and blends thereof.

13. The cap liner of claim 12, wherein said film further includes a layer of metallic film laminated to said thermoplastic material for reducing permeation of fluids through said film.

14. The cap liner of claim 11, wherein said foraminous web is constructed of a thermoplastic material selected from a group consisting of polypropylene, polyethylene, vinyl resins, vinyl acetate copolymer resins and blends thereof.

15. The cap liner of claim 11, wherein said foraminous web is constructed of a foamed thermoplastic material.

16. The cap liner of claim 11, wherein said film is substantially transparent and further including indicia on said first major surface of said film.

17. The cap liner of claim 11, wherein said first major surface of said film is treated to enhance the bonding of said foraminous web to said film.

18. In combination, bottle having an opening;

(a) a (b) a cooperative removable cap secured to said bottle for enclosing said opening; and (c) a cap liner mounted on said cap and interposed between said cap and said bottle, said cap liner including a substantially fluid impervious thermoplastic film having opposing first and second major surfaces, with said second major surface of said film adjacent said bottle, and a resilient compressible foraminous thermoplastic reinforcing web coextensive with said film and bonded to said first major surface of said film, said foraminous web being compressed between said bottle and said cap so as to resiliently urge said film into sealing contact with said bottle circumferentially about said opening.

* * * * *

UNITED STATES PATENT AND TRADEMARK OFFICE

CERTIFICATE OF CORRECTION

PATENT NO. : 4,789,074

DATED : December 6, 1988

INVENTOR(S) : HAK-RHIM HAN

It is certified that error appears in the above-identified patent and that said Letters Patent is hereby corrected as shown below:

Col. 4, line 30, "0.11" should read --.011--.

Col. 6, line 48, "250°" should read --250®--.

Col. 7, line 21, "011" should read --.011--.

Col. 9, line 16, before the word "bottle", insert --(a) a--.

Col. 9, line 17, delete "(a)a".

Signed and Sealed this

Thirtieth Day of May, 1989

*Attest:*

*Attesting Officer*

DONALD J. QUIGG

*Commissioner of Patents and Trademarks*